United States Patent [19]

Hiraga et al.

[11] 4,095,921

[45] Jun. 20, 1978

[54] MULTI-CYLINDER COMPRESSOR HAVING SPACED ARRAYS OF CYLINDERS

[75] Inventors: Masaharu Hiraga, Isesaki, Japan; Brian J. Taylor, Dallas, Tex.

[73] Assignee: Sankyo Electric Co., Ltd., Isesaki, Japan

[21] Appl. No.: 732,349

[22] Filed: Oct. 14, 1976

[51] Int. Cl.[2] ..... F04B 27/08

[52] U.S. Cl. ..... 417/269

[58] Field of Search ..... 417/269–272, 417/521, 534; 74/60; 91/499; 184/6.16, 6.17, 11 R

[56] References Cited

U.S. PATENT DOCUMENTS

| | | | |
|---|---|---|---|
| 2,238,252 | 4/1941 | Davis, Jr. | 417/521 X |
| 2,379,944 | 7/1945 | Willmott | 184/6.26 X |
| 2,618,359 | 11/1952 | Alden | 184/11 R |
| 2,792,789 | 5/1957 | Mizen | 417/269 X |
| 3,057,545 | 10/1962 | Ransom et al. | 417/269 |
| 3,174,436 | 3/1965 | Wanner | 91/492 X |
| 3,667,868 | 6/1972 | Brunner | 417/273 |
| 3,945,765 | 3/1976 | Toyoda et al. | 417/269 |
| 4,005,948 | 2/1977 | Hiraga et al. | 417/269 |

FOREIGN PATENT DOCUMENTS

| | | | |
|---|---|---|---|
| 1,453,671 | 9/1969 | Germany | 417/269 |
| 840,229 | 5/1952 | Germany | 91/499 |
| 663,447 | 12/1951 | United Kingdom | 417/269 |

*Primary Examiner*—Carlton R. Croyle
*Assistant Examiner*—Edward Look
*Attorney, Agent, or Firm*—Hopgood, Calimafde, Kalil, Blaustein & Lieberman

[57] ABSTRACT

A multi-cylinder compressor of the type suitable for use in a vehicle air-conditioning system includes a pair of axially spaced cylinder blocks for receiving a refrigerant fluid therein for compression. First and second sets of pistons are respectively reciprocated within the front and the rear cylinders, respectively by means of first and second sets of rods of different axial lengths. Also disclosed is an improved lubricating system for a compressor which includes a flapper element located near the oil hole to direct oil to the shaft seal for both clockwise and counterclockwise rotation of the compressor. The compressor may also include a slanted surface on the cam rotor for splashing oil onto the compressor housing wall.

15 Claims, 15 Drawing Figures

MULTI-CYLINDER COMPRESSOR HAVING SPACED ARRAYS OF CYLINDERS

The present invention relates generally to compressors, and more particularly to a compressor having particular utility in a vehicular air-conditioning system.

As described in co-pending application Ser. No. 611,161, now U.S. Pat. No. 4,005,948, assigned to the assignee of the present application, compressors are known for use in automobile air-conditioners which include a plurality of cylinders into which a charge of refrigerant fluid is introduced. The fluid in the cylinders is compressed by means of a plurality of pistons which respectively reciprocate within the cylinders. In one type of compressor, the reciprocation of the pistons is produced by the cooperation of a rotating cam rotor and a wobble plate, which converts the rotation of an input shaft to the desired reciprocation of the piston shafts.

The refrigerant fluid compressed in this manner is fed out of the compressor to an external refrigerating unit. A quantity of lubricating oil, which may be included in the input charge, is separated from the refrigerant fluid and is directed into the interior of the compressor where it is passed over moving components of the compressor, such as the shaft and thrust bearings.

The capacity of the conventional compressor, that is, the volume of refrigerant fluid that can be compressed in one rotation of shaft, has heretofore been constrained by the volume and shape of the compressor. The volume and shape of the compressor are both, however, limited, primarily by the space available for the compressor within the vehicle's engine compartment. And with the increasing popularity of smaller automobiles, there is even less space available for air-conditioning compressors in many new automobiles. The size and shape of the compressor is further limited by the fact that the compressor must generally be mounted parallel and close to the vehicle's engine.

The compressor lubrication system described in said co-pending application has been found to improve the efficiency of lubrication by directing an increased amount of lubricating oil to the compressor components. It is, however, desirable to further improve the oil flow to the compressor components and to otherwise provide increased compressor lubrication efficiency, irrespective of whether the compressor is rotating in either the clockwise or counterclockwise direction.

It is an object of the invention to provide a refrigerant compressor having a greater capacity with a relatively compact volume.

It is a further object of the invention to provide a refrigerant compressor in which the diameter of the compressor is reduced as compared to a conventional compressor having a comparable capacity.

It is another object of the invention to provide a compressor of the type described which is efficient and reliable in operation, and relatively easy to maintain.

It is yet a further object of the invention to provide a compressor of the type described which provides greater capacity at reduced driving peak torque, and which also provides reduced torque variation as well as reduced refrigerant pulsation amplitude.

It is still another object of the invention to provide a compressor of the type described which provides improved lubrication efficiency irrespective of the direction of rotation of the compressor.

To these ends, the compressor of the invention includes a pair of axially spaced, stacked arrays of cylinders or cylinder blocks for receiving a refrigerant fluid therein for compression by axially movable pistons. First and second sets of pistons are reciprocated within the cylinders and are respectively connected to first and second sets of connecting rods, which are of different axial lengths. Also disclosed is an improved lubricating system for a compressor which includes a flapper located near the oil hole to direct oil to the shaft seal cavity during both clockwise and counterclockwise rotation of the compressor. The lubricating portion of the compressor may also include a slanted surface on the cam rotor for splashing oil onto the compressor housing wall, from where it may be readily and efficiently redirected for recirculation to the compressor components.

To the accomplishment of the foregoing and of such further objects as may hereinafter appear, the present invention relates to a refrigerant compressor substantially as defined in the appended claims and as described in the following detailed specification considered together with the accompanying drawings, in which:

FIG. 3 is a cross-sectional view taken along the direction of the arrows 3—3 in FIG. 1;

Figure 2:
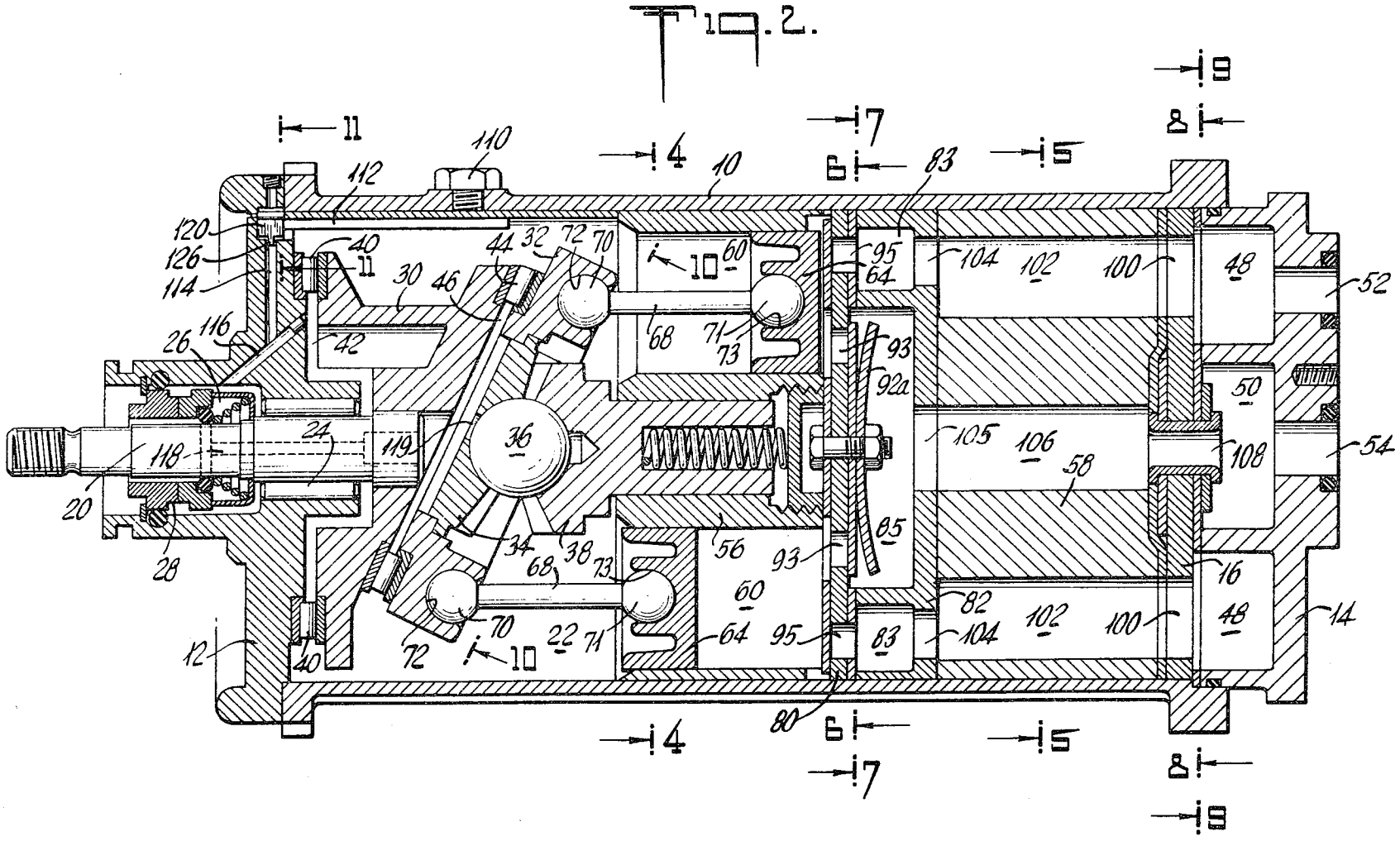
FIG. 2 is a cross-sectional view taken in the direction of the arrows 2—2 in FIG. 1.
Figure 5:
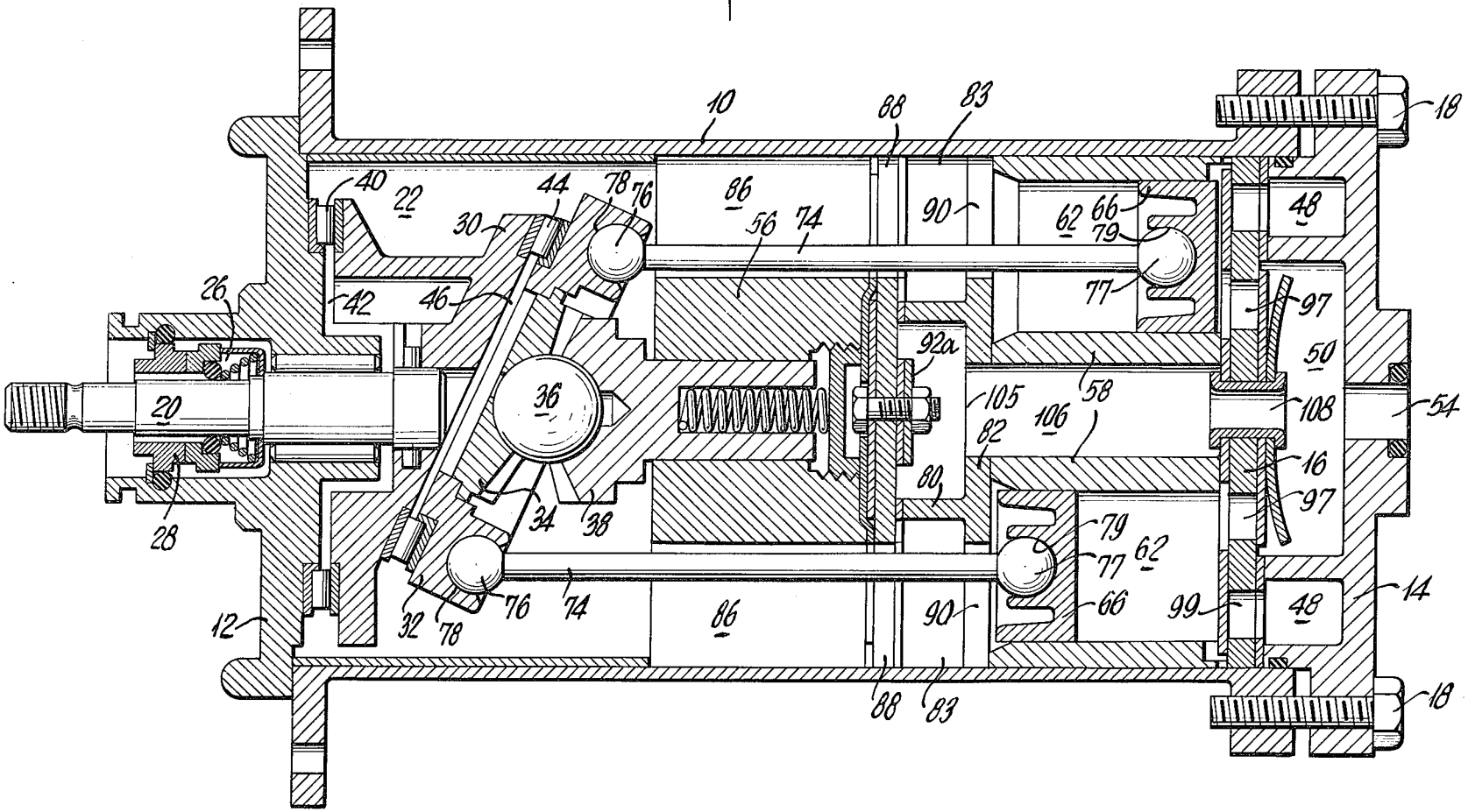
Figure 8:
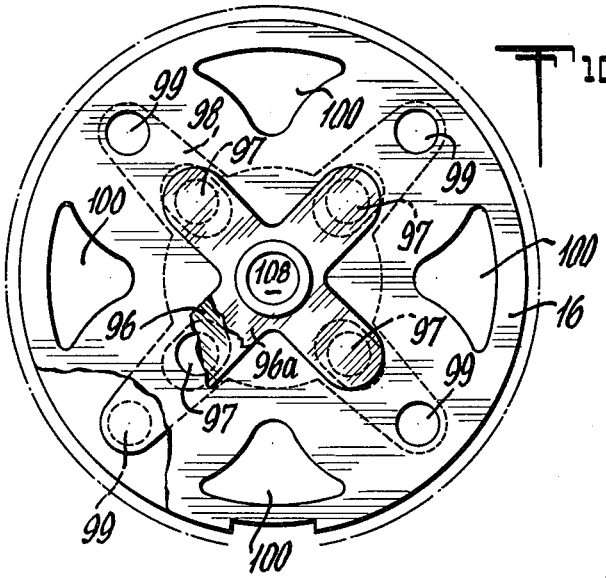
FIG. 8 is a cross-section as viewed in the direction of the arrows 8—8 in FIG. 2.

Referring to FIGS. 2 and 3, there is shown in vertical cross-section an embodiment of the refrigerant compressor of the invention which includes a generally cylindrical housing 10 having a front cover plate 12 attached to the front end of the housing, and a cylinder head 14, which along with a rear valve plate 16, is attached to the rear end of the housing by means such as bolts 18.

A shaft 20 extends through a central opening in front cover plate 12 into a hollow portion 22 of housing 10 and rotates within a journal bearing 24 provided in the front cover plate. A shaft seal cavity 26 is formed in the front cover plate and surrounds shaft 20. The shaft seal cavity includes a shaft seal assembly 28 which seals the shaft. A wedge-shaped cam rotor 30 is secured to the inner end of shaft 20 and is rotatable along with the shaft. The surface of a wobble plate 32, which has an oscillating bevel gear 34 in its central portion, is positioned in close proximity to the sloping cam surface of rotor 30. Bevel gear 34 is able to nutate about a ball bearing 36 seated within a fixed bevel gear 38.

Thrust bearings 40 are provided between rotor 30 and front cover plate 12, and define a gap 42 between the rotor and front cover plate which extends about a portion of the shaft. Similarly, a thrust bearing 44 is provided between rotor 30 and wobble plate 32 and defines a gap 46 between the rotor and the wobble plate.

The cylinder head 14 is shaped to provide an annular suction chamber 48 and a discharge chamber 50. A refrigerant gas is introduced into the compressor through a suction port 52 provided in cylinder head 14, which is in communication with suction chamber 48. In a manner described more completely in a later part of this specification, the refrigerant gas is compressed in a number of cylinders, and is then discharged into discharge chamber 50, and from there it passes out of the compressor to an external refrigeration unit (not shown) through discharge port 54 which is in communication therewith.

The compression of the refrigerant fluid in the compressor is brought about by the conversion, by the wobble plate, of the rotation of the shaft into the reciprocating movement of a plurality of pistons into a corresponding plurality of cylinders into which the refrigerant fluid is introduced for compression.

In the conventional refrigerant compressor of the wobble plate type, the cylinders in which the refrigerant fluid is compressed are arranged in a single array lying substantially in a single plane. The amount of refrigerant fluid that can be compressed and the cooling capacity of the unit of which the compressor is a part, are, therefore, limited by the volume of the cylinders which, in turn, is limited by the size of the compressor. In the compressor of the invention, the capacity of the compressor is substantially increased with no significant increase in the diameter of the compressor.

To this end, the compressor of the invention includes a first cylinder block 56 at the front or inboard end of the interior of the compressor housing, and a second cylinder block 58 spaced axially, rearwardly of the first cylinder block. As can be seen best in FIGS. 4 and 5, front cylinder block 56 includes a first array of cylinders 60, circumferentially spaced from one another by 90°, whereas the rear cylinder block 58 includes a second array of cylinders 62 which are also circumferentially spaced 90° from one another and angularly displaced by 45° from the cylinders 60 in the front cylinder block.

Figure 10:
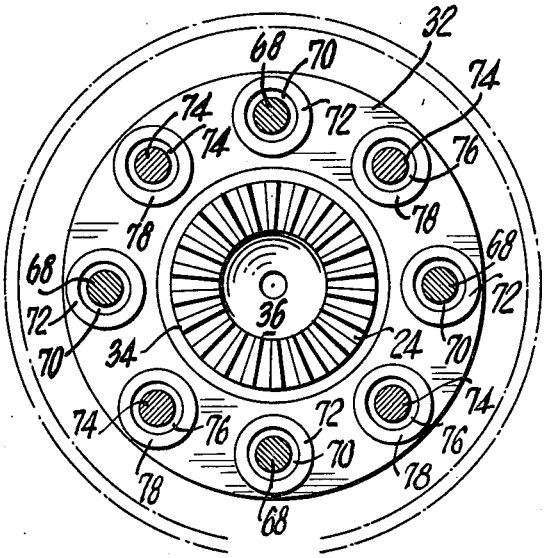
FIG. 10 is an elevation of the wobble plate and bevel gear of the compressor as viewed in the direction of the arrows 10—10 in FIG. 2.
Figure 11:
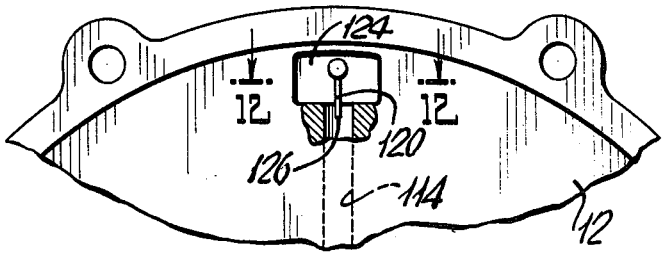
FIG. 11 is a partial cross-section, on an enlarged scale as compared to FIG. 2, as viewed in the direction of the arrows 11—11 in FIG. 2.

Pistons 64, 66 are respectively axially movable within cylinders 60 and 62. Balls 71 at one end of a group of relatively short piston rods 68 (FIG. 2) are connected to piston ball sockets 73, and balls 70 at the other ends of rods 68 are secured to wobble plate 32 in sockets 72 formed about the periphery of the wobble plate. Similarly, balls 77 at one end of a group of relatively longer rods 74 (FIG. 3) are connected to piston ball sockets 79, and balls 76 at the other ends of rods 74 are secured to balls 76, which are securely received in sockets 78 formed about the periphery of wobble plate 32. Thus, as shown in FIG. 10, the short and long pistons rods 68, 74 are secured in an alternating and equally spaced arrangement about the periphery of the wobble plate. As seen in FIG. 10, the long piston rods 74 are angularly spaced from one another by 90° and by an angular displacement of 45° from the adjacent short piston rods 68, which are also spaced from one another by 90°.

A front valve plate 80 is interposed between the front and rear cylinder blocks to control the flow of refrigerant fluid into and out of cylinders 60 in the front cylinder block. A similar function is performed for refrigerant fluid in the cylinders 62 in the rear cylinder block by rear valve plate 16. Also disposed between the front and rear cylinder blocks is a chamber separator 82.

The chamber separator 82 is shaped to provide an annular suction chamber 83 and a discharge chamber 85 between the front valve plate 80 and the rear cylinder block.

Figure 1:
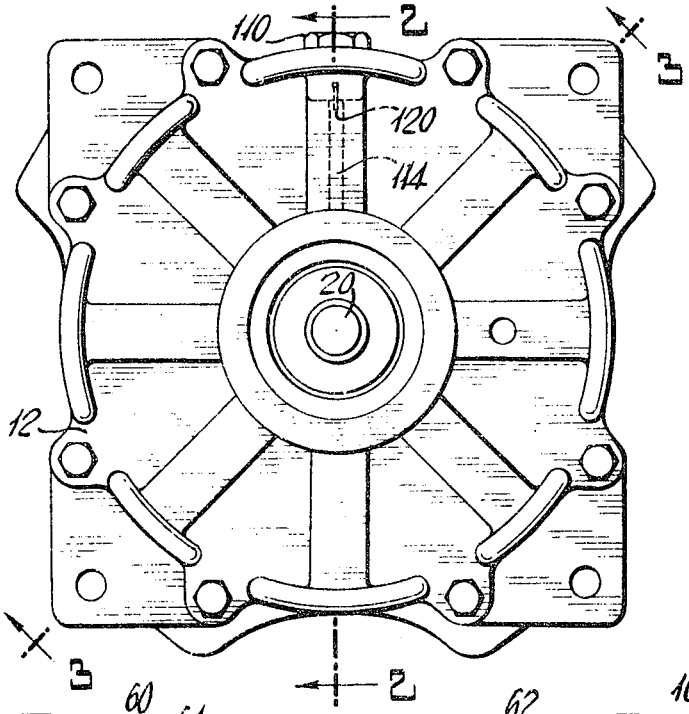
FIG. 1 is an elevation of the front end of a refrigerant compressor according to an embodiment of the invention.
Figure 4:
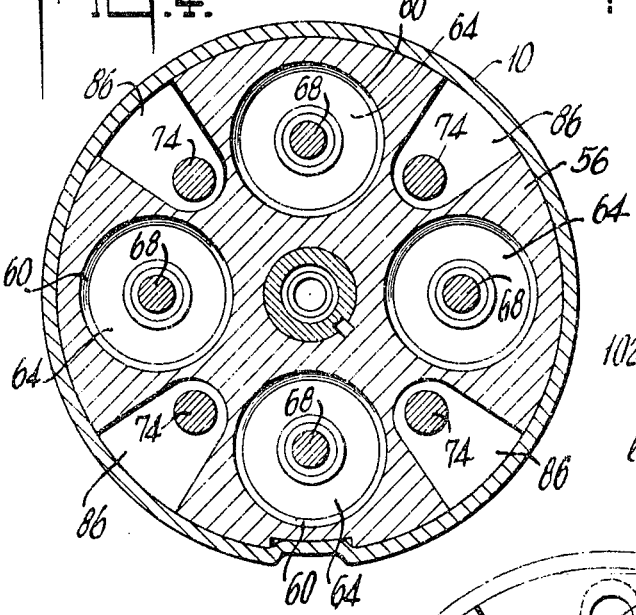
FIG. 4 is a cross-section as viewed in the direction of the arrows 4—4 in FIG. 2.
Figure 5:
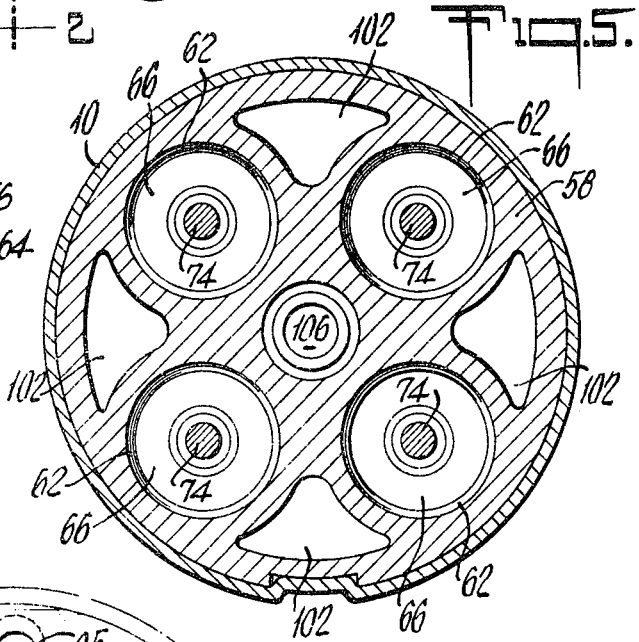
FIG. 5 is a cross-section as viewed in the direction of the arrows 5—5 in FIG. 2.

In order to allow the long piston rods 74 to freely reciprocate within cylinders 62, clearances therefor are provided in the front cylinder block 56, the front valve plate 80, and the chamber separator 82. Thus, clearances 86 for the long rods are formed in the front cylinder block 56 (FIG. 4). Similarly shaped clearances 88 are provided in front valve plate 80 (FIG. 6), and similar clearances 90 are provided in the chamber separator 82 (FIG. 7). Clearances 86, 88 and 90 for the long piston rods are axially aligned with one another within the compressor housing.

Figure 6:
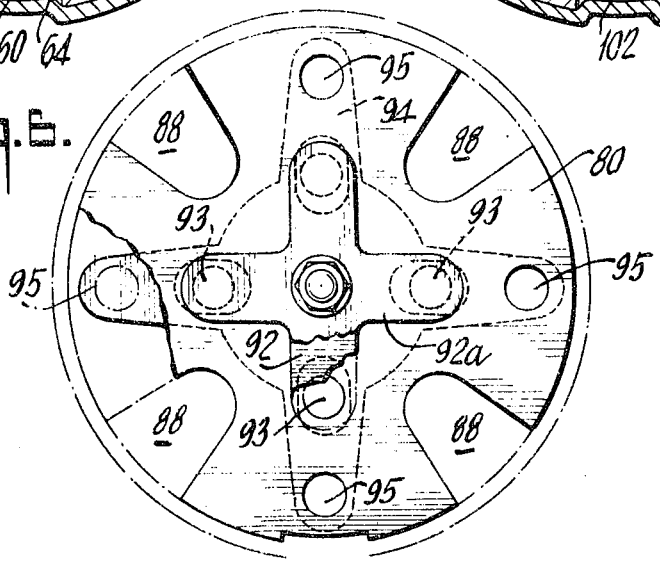
FIG. 6 is a cross-section as viewed in the direction of the arrows 6—6 in FIG. 2.
Figure 7:
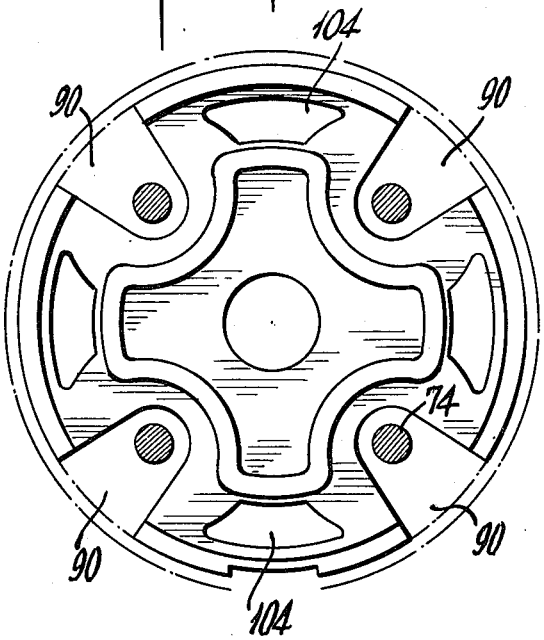
FIG. 7 is a cross-section as viewed in the direction of the arrows 7—7 in FIG. 2.
Figure 9:
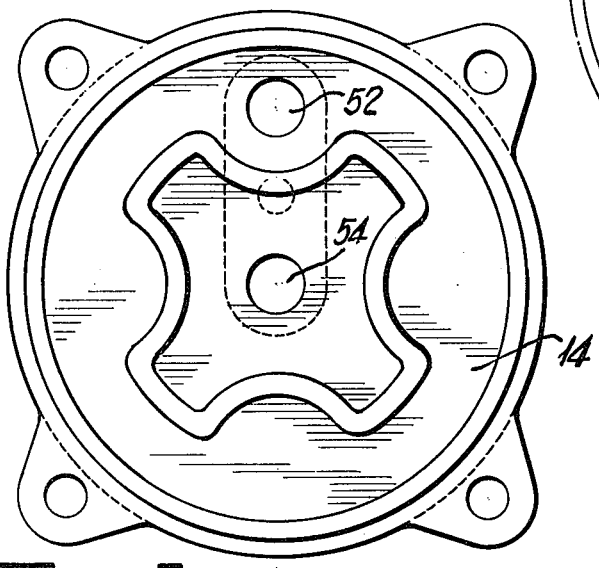
FIG. 9 is a cross-section as viewed in the direction of the arrows 9—9 in FIG. 2.

As shown in FIG. 6, the front valve plate assembly 80, having discharge ports 93 and suction ports 95, includes a discharge reed valve 92, a suction reed valve 94, and a discharge reed stop **92*a*; valves 92, 94 and reed stop 92*a* are secured to valve plate 80. Similarly, the rear valve plate assembly 16, having discharge ports 97, and suction ports 99, includes a discharge reed valve 96, a suction reed valve 98, and reed stop 96*a*; valves 96, 98, and reed stop 96*a* are secured to the rear valve plate 16**.

Rear valve plate 16 also includes suction gas openings 100, which are in axial alignment with similarly shaped suction gas openings 102 provided in rear cylinder block 58, and suction gas openings 104 provided in chamber separator 82. Suction gas openings 100, 102 and 104 communicate the front suction chamber 83 with the rear suction chamber 48 to provide, through the suction reed valve 94 of the first valve assembly, fluid communication between the rear suction chamber and the cylinders 60 in the front cylinder block. Similar communication is achieved between the suction chamber and the cylinders 62 in the rear cylinder block via the suction reed valve 98 in the rear valve assembly. Communication between the front cylinders 60 and the discharge chamber 50 is effected through ports 93 in discharge reed valve 92, a central discharge gas opening 105 in the chamber separator 82, a discharge passageway 106 in the rear cylinder block, and a discharge gas opening 108 in the rear valve plate through the front discharge chamber 85.

In the operation of the compressor, the rotation of shaft 20, which is typically driven by the vehicle engine through a clutch (not shown), causes wobble plate 32 to nutate, to, in turn, produce reciprocatory motion of the short and long piston rods 68, 74 within cylinders 60 and 62, respectively, thereby to compress refrigerant fluid introduced through the various suction ports into the cylinders. The thus compressed fluid is subsequently discharged through the various discharge passageways to an external refrigeration unit (also not shown).

In another aspect of the invention, the compressor is provided with improved means for circulating lubricating fluid, (which may be introduced into the compressor initially through an oil filter plug 110 at the compressor factory), through the moving parts of the compressor which are the shaft seal, the journal bearing, the rotor, the thrust bearings, and the centering ball. This lubrication system constitutes an improvement over the arrangement disclosed in said co-pending application, Ser. No. 611,161.

Figure 12:
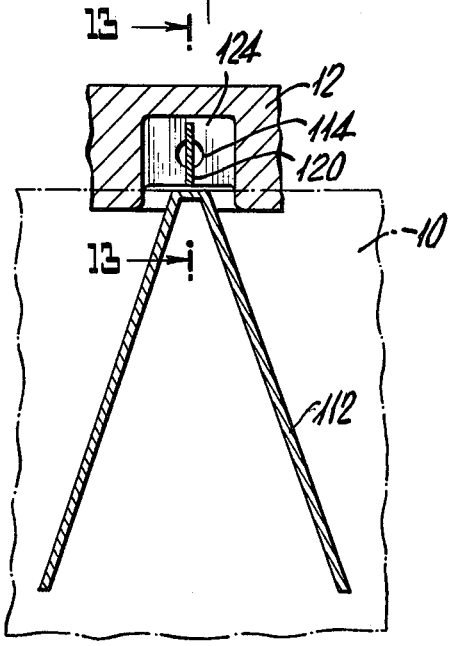
FIG. 12 is a section as viewed in the direction of the arrows 12—12 in FIG. 11.

As in the compressor disclosed in said co-pending application, an oil deflector 112 (FIGS. 2 and 12) is provided on the upper part of the inner wall of housing 10, and has an apex or termination adjacent an oil hole opening 114 formed in the front cover plate 12. As also described in said co-pending application, deflector 112 deflects or redirects lubricating oil splashed during compressor operation onto the interior upper wall of the housing into oil opening 114. Opening 114 communicates, as shown in FIG. 2, through an oil passageway 116 with the shaft seal cavity 26 and to gap 42 to lubricate the shaft bearings and thrust bearings 40, and through an axial passageway 118 formed in the rotor shaft 20 to gap 46, whereby thrust bearings 44 receive lubrication fluid, and also to a hole 119 provided on the rear surface of the oscillating bevel gear 36, whereby the center ball bearing 36 receives lubrication fluid.

Figure 13:
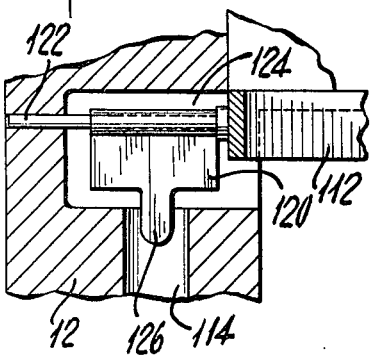
FIG. 13 is a section as viewed in the direction of the arrows 13—13 in FIG. 12.

The compressor of the invention further includes a flapper 120, which is pivotably mounted on a pin 122 secured to front cover plate 12. Flapper 120 is thus pivotable within a recess 124 formed in the front cover plate and is positioned over and normally centrally located with respect to the oil opening 114. As shown in FIG. 13, flapper 120 may include a depending finger 126 which extends into oil opening 114. In operation, flapper 120 pivots either clockwise or counterclockwise, depending upon the direction of rotation of the compressor, so as to automatically be in a position that is offset from the oil opening 114, so as to channel lubricating oil into the oil opening 114, from where, as described previously, the oil is directed to the moving parts of the compressor. In this manner, an increased use is made of the lubricating oil in the compressor for lubricating purposes.

Figure 14:
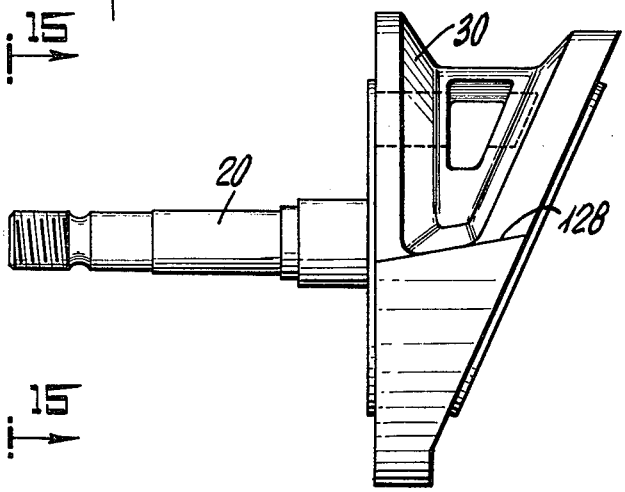
FIG. 14 is a side elevation of the cam rotor of the refrigerant compressor.
Figure 15:
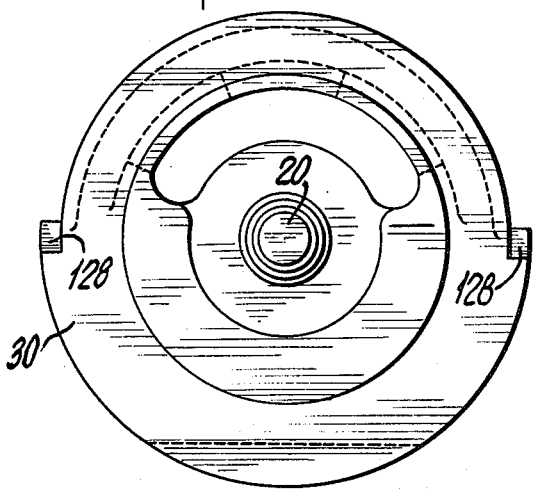
FIG. 15 is an end elevation of the cam rotor.

To further enchance the lubrication efficiency of the compressor, the cam rotor 30 is modified to include a slanted surface 128 (FIGS. 14 and 15) at each of the peripheral side edges of the rotor. As seen best in FIG. 14, surface 128 slopes upwards in the axial rearward direction of the compressor. In operation of the compressor, as the rotor 30 rotates, slanted surface 128 of the rotor splashes oil upwards against the wall of the housing 10, from where the thus splashed oil is directed by oil deflector 112 and flapper 120 into the oil opening 114, as described above.

It will be appreciated from the foregoing description of the compressor of the invention according to the embodiment thereof specifically described herein, that increased refrigeration capacity is achieved in a compressor having substantially the same diameter as a conventional compressor, by providing the cylinders, in which the refrigerant fluid is compressed, in two axially spaced, or stacked, and angularly offset arrays. The compressor further includes in improved arrangement for deflecting an increased amount of lubricating oil into the oil opening for recirculation to the moving parts of the compressor, irrespective of the direction of rotation of the compressor.

Although the compressor of the invention is hereinabove described as including four cylinders in each of two arrays, the number of cylinders in each of the arrays, as well as the number of stacked arrays, may be modified. It will thus be apparent that these and other modifications may be made in the embodiment of the invention specifically described, without necessarily departing from the spirit and scope of the invention.

What is claimed is:

1. A compressor comprising a housing having first and second end members, one of said end members defining inlet and outlet means for a fluid to be compressed, a first cylinder arranged within said housing, a second cylinder arranged within said housing and spaced axially from said first cylinder, means for directing fluid to and from said first and second cylinders, first and second piston means respectively axially movable within said first and second cylinders and respectively defining with said first and second cylinders first and second pump chambers, a rotor extending through the other of said end members into the interior of said housing, a wobble plate operatively connected to said rotor for rotation therewith, and first and second angularly offset drive means of different axial lengths operatively connected to said wobble plate and respectively to said first and second piston means for respectively imparting reciprocating movement to said first and second piston means within said first and second cylinders, thereby to compress the fluid in said pump chambers in said first and second cylinders.

2. The compressor of claim 1, in which said first cylinder is included in a first array of cylinders, and said second cylinder is included in a second array of cylinders axially spaced from said first array of cylinders.

3. The compressor of claim 2, comprising a first plurality of drive means operatively connected to said wobble plate and to a first plurality of said first piston means, and a second plurality of drive means operatively connected to said wobble plate and to a plurality of said second piston means, said first plurality of drive means being of substantially a first axial length, said second plurality of drive means being of substantially a second axial length different than said first axial length.

4. The compressor of claim 2, in which said cylinders in said second array are angularly offset from said cylinders in said first array, said first array of cylinders being formed in a forward cylinder block which includes a plurality of openings which are angularly offset from said cylinders in said first array and in axial alignment with said cylinders in said second array.

5. The compressor of claim 4, in which said piston-reciprocating means comprises a first group of rods of a first length secured to said first piston means and said rotation-converting means, and a second group of piston rods of a second length greater than that of said first group of piston rods and connected to said second piston means and to said rotation-converting means.

6. The compressor of claim 5, in which said first and second groups of rods are connected at one end thereof in an alternating angularly spaced arrangement about the periphery of said wobble plate.

7. The compressor of claim 2, further comprising a front cylinder block including said first array of cylinders, a rear cylinder block axially spaced from said front cylinder block and including said second array of cylinders, and a valve plate interposed between said front and rear cylinder blocks.

8. The compressor of claim 7, in which said front cylinder block includes a plurality of openings angularly spaced from said first array of cylinders, said second drive means respectively passing through said openings for movement therethrough.

9. The compressor of claim 8, further comprising a separator interposed between said front and rear cylinder blocks and having a plurality of openings in alignment with a plurality of openings in said front valve plate and with said plurality of openings in said front cylinder block.

10. The compressor of claim 9, in which said separator also includes an axial opening in fluid communication with a discharge opening in said rear cylinder block and with said outlet means.

11. In a compressor including a main housing for receiving therein a quantity of a fluid and a lubricant, fluid-compressing means within said main housing, a front plate secured to said main housing, means including a rotating shaft extending through said front plate and into the interior of said main housing for operating said fluid-compressing means, and a lubricant opening formed in said front plate and in communication with the interior of said main housing, the improvement which comprises: means pivotably mounted to the interior of said front plate and pivotable about its axis in one of a first and second direction in accordance with the direction of rotation of said shaft, said pivotable means being located adjacent said lubricant opening for deflecting lubricant incident thereon into said lubricant opening.

12. The improvement of claim 11, in which said pivotable deflecting means includes a post fixedly secured to said front plate at a location above said lubricant opening, and a flapper element pivotably mounted on said post and having a portion extending below said post and over said lubricant opening.

13. The improvement of claim 11, further including a fixed lubricant-directing member secured to the inner wall of said main housing and positioned so as to deflect lubricant onto said pivotable deflecting means for deflection of lubricant into said lubricant opening.

14. The improvement of claim 11, in which said operating means includes a cam rotor mounted on said shaft for rotation therewith and located within the interior of said main housing, said cam rotor including a sloping surface formed on the outer periphery thereof for directing lubricant incident thereon toward said lubricant opening and said pivotable deflecting means.

15. A compressor including a main housing, at least one chamber for receiving therein a fluid, means for compressing said fluid in said chamber, means for imparting fluid compression motion to said compressing means, said last-mentioned means including a shaft and a rotor affixed thereto, a front plate having a lubricant opening therein in communication with the interior of said main housing, said rotor having an upwardly sloping surface formed on the outer periphery thereof for directing a quantity of lubricant incident thereon toward said lubricant opening, a deflecting element located adjacent said lubricant opening for deflecting oil directed thereto by said sloping surface to said lubricant, and a flapper element pivotably mounted to the interior of said front plate and positioned adjacent said lubricant opening and said deflecting element.

* * * * *